United States Patent [19]

Tilby et al.

[11] 4,312,677

[45] Jan. 26, 1982

[54] APPARATUS FOR SEPARATING THE COMPONENTS OF PLANT STALKS

[75] Inventors: Sydney E. Tilby, Victoria; Branko Vukelic, Windsor, both of Canada

[73] Assignee: Intercane Systems, Inc., Windsor, Canada

[21] Appl. No.: 120,773

[22] Filed: Feb. 12, 1980

[51] Int. Cl.[3] ..... C13C 1/02

[52] U.S. Cl. ..... 127/2; 83/425; 56/500; 209/3; 198/605; 241/276

[58] Field of Search ..... 127/2; 198/605; 83/425; 130/500; 209/3; 241/276

[56] References Cited

U.S. PATENT DOCUMENTS

| | | | |
|---|---|---|---|
| 3,232,218 | 2/1966 | Soussloff | 100/37 |
| 3,424,611 | 1/1969 | Miller | 127/2 |
| 3,424,612 | 1/1969 | Miller | 127/2 |
| 3,567,510 | 3/1971 | Tilby | 127/2 |
| 3,567,511 | 3/1971 | Tilby | 127/2 X |
| 3,873,033 | 3/1975 | Tilby | 127/2 X |
| 3,976,498 | 8/1976 | Tilby | 127/2 |
| 3,976,499 | 8/1976 | Tilby | 127/2 X |
| 4,151,004 | 4/1979 | Vukelic | 127/2 |
| 4,170,286 | 10/1979 | Villanueva | 198/605 X |
| 4,192,639 | 3/1980 | Jones | 198/605 X |

*Primary Examiner*—Sidney Marantz

*Attorney, Agent, or Firm*—Burns, Doane, Swecker & Mathis

[57] ABSTRACT

A separator for separating plant stalks into components includes a feeder in the form of opposite endless conveyors which propel stalks against a splitter. The splitter comprises two oppositely traveling, notched bands which are in contact to define a cutting edge. Stalk sections have at least their pith removed by a milling roll disposed opposite a slower traveling hold-back belt, the latter controlling the speed of the stalk sections. The milling roll includes removable blades which are held in place by wedges and pairs of blades are adjusted by tiltable members at each blade end. The tiltable members move the blades into contact with reference surfaces on the milling roll to define a proper blade location. Stalks are fed to the separator by being dropped onto a chute which guides the stalks into separate feed passages, the latter being maintained throughout stalk travel through the separator. The chute includes passage divider walls having cutters for separating partially cut stalks which may become hung-up thereon. The stalks travel to a spreader station at which vertically superimposed conveyor belts spread the stalks into a single layer. A method for releasing a stuck journal from a roll includes screwing an ejector bolt into an end of the journal until, in effect, it pushes off from a fastening bolt of the journal and against the journal itself to release the latter.

15 Claims, 20 Drawing Figures

Fig. 15
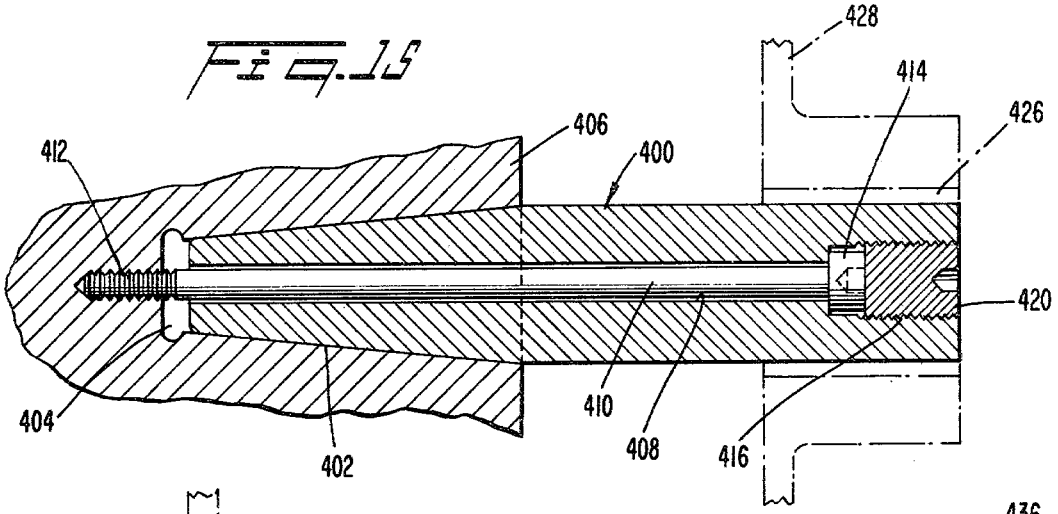
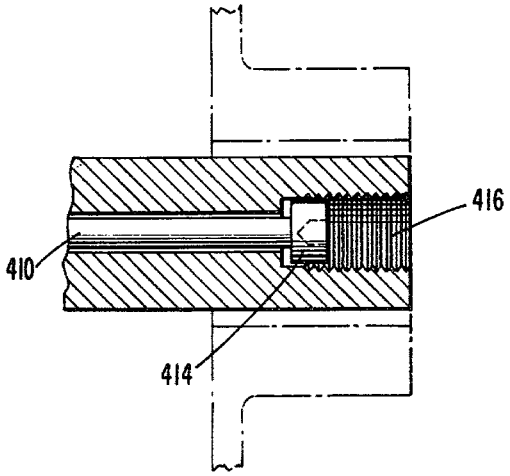
Fig. 16
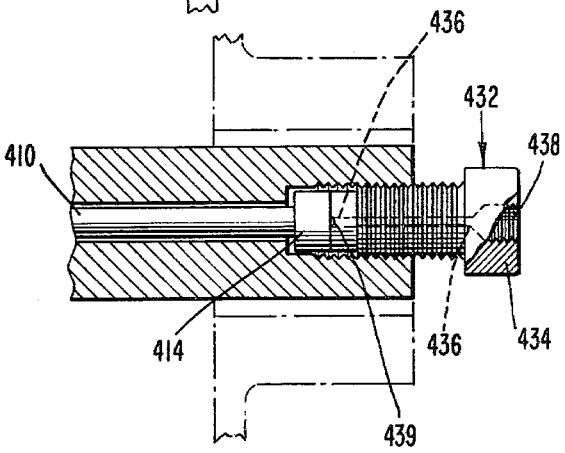
Fig. 17
Fig. 18
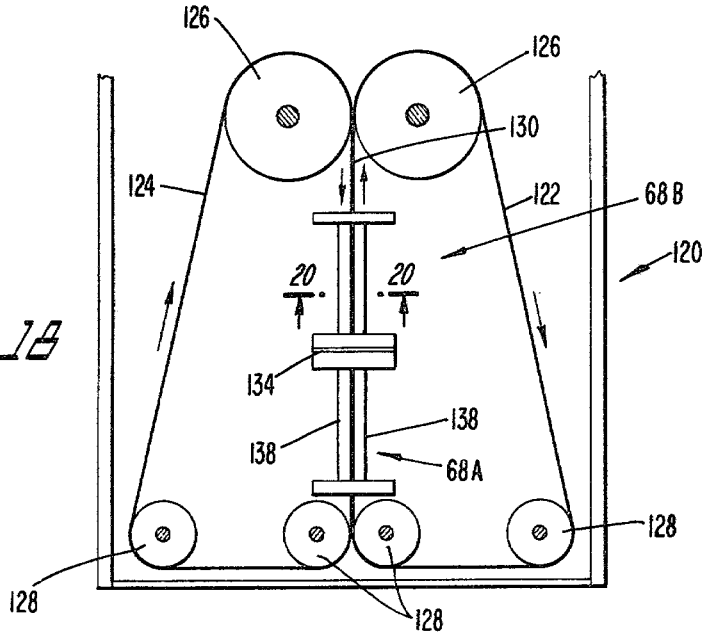

APPARATUS FOR SEPARATING THE COMPONENTS OF PLANT STALKS

BACKGROUND AND OBJECTS OF THE INVENTION

The present invention relates to the mechanical separation of plant stalks into component parts for the individual recovery of same.

Apparatus and techniques for separating plant stalks, such as sugarcane, into individual parts, e.g., epidermis, pith, and rind have been heretofore disclosed in U.S. Pat. Nos. 3,424,611 and 3,424,612 issued to R. B. Miller on Jan. 28, 1969, and U.S. Pat. Nos. 3,567,510 and 3,976,498 issued to S. E. Tilby on Mar. 2, 1971 and Aug. 24, 1976, respectively.

Apparatus and techniques in accordance with the above-mentioned patents of S. E. Tilby have proven highly successful in the separation of plant stalks. Basically, the apparatus and techniques of above-referenced Tilby U.S. Pat. No. 3,976,498 involve a stalk separator comprising a pair of cylindrical feed rolls driven on opposite sides of a stalk-splitting blade. The rollers are resilient and define a nip which captures oncoming chopped pieces or billets of stalk that fall from the lower end of a guide chute, and force such billets against the blade whereupon they are split longitudinally in half. Each billet half is then transferred to a pith-removing station and then, possibly, to an epidermis removing station. At each such station there is disposed a milling roll and an opposing hold-back roll, which rolls are driven in the same direction through their nip but at different speeds. The milling roll is driven at a higher speed and comprises cutting edges which mill the pith (or epidermis) from the rind. The hold-back roll includes rearwardly raked teeth which penetrate the rind to control its travel speed as it passes through the nip. If an epidermis removing station is also employed, the billet half is delivered from the pith removing station along a guide plate to the epidermis removal station.

Although the above-described separator has functioned successfully, certain problems have been encountered. For example, there may occur an occasional tendency for billets to be fed by the feed rolls against the splitting blade in skewed or non-longitudinal orientation. This occurs primarily in connection with shorter billets, i.e., end pieces or stubs of the stalks which are shorter than the normal billet length and are unable to entirely bridge the gap between the lower discharge end of the guide chute and the nip of the feed rolls. As a result, billet-jamming may occur.

Still another problem relates to a tendency for certain types of trash, such as leaves for example, which may be carried along with the billets, to become hung-up on the edge of the splitter blade. Build-ups of such trash require that the separator be shut-down, opened and cleared.

Another problem which has been encountered relates to the pith and epidermis removal stations. The high speed of the milling roll imposes great forces on the billets which must be resisted by the hold-back roll. Despite the presence of the rind-penetrating teeth on the hold-back roll, the latter may, on occasion, lose control of the billet which is propelled forwardly without being fully stripped of its pith (or epidermis).

Still another problem occurs when billets discharged from the pith removal station are fed onto a downstream guide plate, because rind fibers of the billets tend to become hung-up on the leading end of the guide plate. An ensuing build-up of such fibers requires the separator to be shut-down and cleared. This problem has been previously eliminated by the provision of a continuously driven plate-clearing roll which removes such caught fibers, as disclosed in U.S. Pat. No. 4,151,004 issued on Apr. 24, 1979 to Branko Vukelic. Although effective, the clearing roll constitutes still another component in the separator which must be separately installed, driven, and maintained, and thus increases the overall complexity of the machine.

An inconvenience encountered during operation of the separator involves the maintenance of the sharp cutting edges on the blades of the milling roll. When the cutting edges of the blades become dulled, it is necessary that they be reground. Of course after being reground, the cutting blades may be of different dimension and/or shape, and it can thus be difficult to reposition them on the milling roll such that the cutting edges are properly located relative to the billets being treated. This problem is further complicated by the fact that separators of this type may be operated in areas where few skilled workers are available.

Yet another problem involves quick-release journal mounts for the various rotary rolls of the separator, described in afore-mentioned Tilby U.S. Pat. No. 3,976,498. Such a quick-release involves bearing-mounted journals which have tapered ends engaging tapered axial openings of a roll. The journals can each be released from the roll by the removal of a single bolt. Consequently, the roll may simply be dropped-out from between the bearings. It has occurred on occasion that the journals become stuck within the roll, requiring that high pressure grease be fed into the roll opening to release the journals. This procedure is costly and messy and it would be desirable to eliminate the need for same.

SUMMARY OF THE INVENTION

These objects are achieved by the present invention which involves a stalk separator of the type comprising a stalk splitter, a stalk feeder for advancing plant stalks longitudinally against a cutting edge of the splitter to split the stalks longitudinally, and a mechanism for removing at least a pith component from each split stalk section. The feeder comprises a pair of endless conveyors including mutually facing stalk gripping sections disposed on opposite sides of the splitter. These gripping sections together define a stalk-conveying nip extending at least as far as the cutting edge so that the stalks are positively advanced through the cutting edge. The belt includes a stalk contacting portion facing the milling roll to define a nip therebetween for receiving stalk sections. The stalk contacting portion of the hold-back conveyor extends beyond an upstream end of the support surface. The milling roll and hold-back conveyor are driven at different speeds in the direction of stalk travel, the hold-back conveyor driven slower than the milling roll to control the speed of travel of the stalk sections such that the milling roll cuts through the pith of each stalk section faster than the speed of travel of the stalk section to remove the pith therefrom.

Preferably, the milling roll comprises a rotary hub and a plurality of radially projecting cutting blades removably carried by the hub. Each blade includes at least one cutting edge. Fasteners releasably secure the blades to the hub. Reference surfaces are carried by the hub at opposite ends of the blades which when contacted by opposite ends of the blades orient the cutting edge of each blade parallel to the axis of rotation of the hub. An adjustable member displaces the ends of each blade radially outwardly into engagement with the reference surfaces.

Preferably, upstream of the stalk feeder, stalks are delivered to an inclined slide ramp including an upper end onto which the stalks are dropped. At least one divider wall extends out from the ramp to define a plurality of feed channels for guiding the stalks as they slide along the ramp. An upper end of the divider wall is inclined relative to horizontal such that partially-cut stalks which become hung-up thereon slide downwardly and are cut by a driven cutter.

Preferably, stalks being fed to the feeder travel along an endless delivery conveyor having an inclined portion and a horizontal portion disposed downsteam therefrom. An endless spreader conveyor is disposed closely atop a horizontal portion of the delivery conveyor and defines a nip therewith having an inlet facing the inclined portion of the delivery conveyor. The spreader conveyor extends around a guide roll at the nip inlet. The guide roll is yieldably deformable to permit passage of stalks into the nip. A pressure roll formed of an unyielding material is disposed opposite the guide roll. The delivery and spreader conveyors are driven at a common speed such that the inclined portion of the delivery conveyor conveys stalks to the nip inlet and the spreader conveyor rejects stalks not lying flush on the delivery conveyor.

The present invention includes a method for releasing a stuck journal of the type having a tapered end which is mounted in a correspondingly tapered opening of a roll. The journal is secured by a fastener bolt which passes axially through the journal. If the journal becomes stuck, the fastener bolt is partially unthreaded and an ejector bolt is threaded into the journal until further movement is resisted by the fastener bolt. Further rotation of the ejector bolt causes the latter, in effect, to push off from the bolt and against the journal to release same.

BRIEF DESCRIPTION OF THE DRAWINGS

These objects and advantages of the invention will become apparent from the following detailed description of a preferred embodiment thereof in connection with the accompanying drawings in which like numerals designate like elements, and in which:

FIG. 15 is a partial view, in longitudinal cross-section, of a mounting journal for a rotary component of the stalk handling mechanism;

FIGS. 16 and 17 show, respectively, steps performed to free the journal when it becomes stuck in the roll;

FIG. 18 is a plane view of an alternate form of stalk splitting mechanism according to the present invention;

FIG. 19 is a fragmentary side elevational view of the stalk splitting mechanism of FIG. 18; and FIG. 20 is a cross-sectional view taken along line 20—20 of FIG. 18.

DETAILED DESCRIPTION OF A PREFERRED EMBODIMENT OF THE INVENTION

Figures 1, 3, 4:
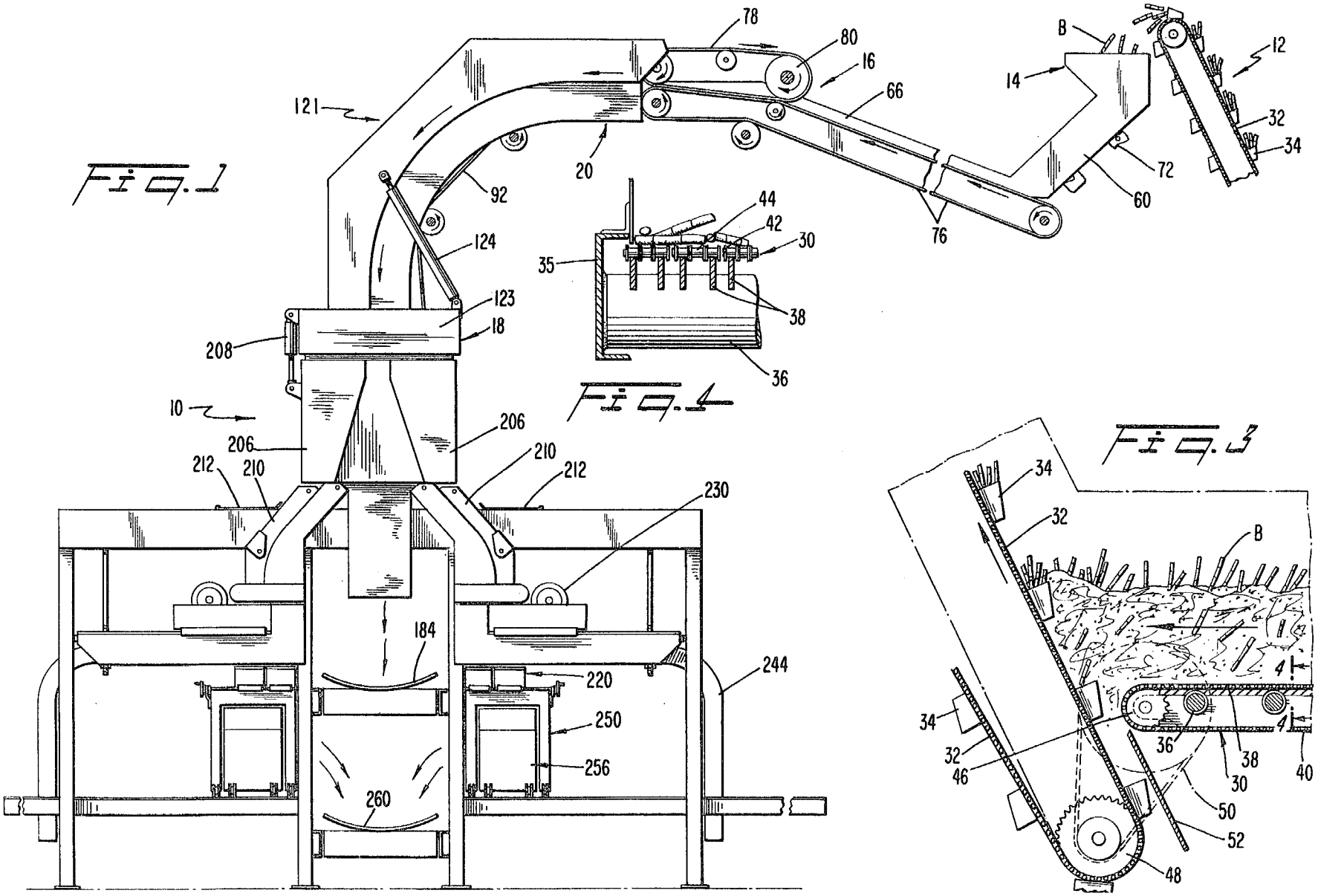
FIG. 1 is a side elevational view of a plant stalk handling mechanism in accordance with the present invention.
FIG. 3 is a side elevational view of a stalk supply station where plant stalks are supplied to a metering conveyor.
FIG. 4 is a partial cross-sectional view taken along line 4—4 of FIG. 3.

A preferred plant stalk handling mechanism 10 according to the present invention is depicted in FIG. 1 and comprises a stalk supply station 12 which receives a mass of randomly oriented pre-chopped plant segments or billets B and conveys them upwardly in metered quantitites to a divider station 14 in which the billets are diverted into two or more feed channels and are oriented longitudinally therewithin, i.e., are aligned with the direction of feed. The aligned billets are transported to a spreader station 16 which spreads out the billets to form a single layer thereof in each feed channel. The billets are then conveyed to a separator 18 which comprises a feeding station 20 wherein the aligned billets are fed to a splitting station 22 (FIG. 2) to be split longitudinally in half. Each billet half is then conveyed to a pith milling station 24 (FIG. 2) and, if desired, an epidermis milling station 26 (FIG. 2) where pith and epidermis components of the billet are removed from the rind component thereof. Those components are recovered separately for later processing.

Stalk Supply Station

The stalk supply station 12 (FIGS. 1, 3 and 4) comprises a horizontal endless transport conveyor 30 which receives a mass of randomly oriented plant stalks that have been previously detrashed and/or chopped into short billets B, e.g., of ten inches in length for example. The transport conveyor 30 transports such billets B to an endless metering conveyor 32. The metering conveyor 32 is inclined relative to vertical and comprises an endless chain-type conveyor to which are mounted a plurality of open-top buckets 34. As the buckets travel upwardly, they scoop billets from the mass of billets which is continuously forced against the metering conveyor 32 by the transport conveyor 30.

The transport conveyor 30 comprises a pair of spaced side frames 35 (one shown in FIG. 4) between which are mounted a plurality of lateral bars 36. The bars 36 are mutually spaced in the direction of stalk transport and carry longitudinally extending, laterally spaced metal slats 38. Mounted on the slats is a movable conveyor bed 40 formed of multiple-strand roller chains. The roller chains comprise longitudinal links 42 and rollers 44 freely rotatably mounted between adjacent links. The bed is mounted on the slats such that the slats lie between adjacent links and form tracks for the rollers. The link strands are connected to driven sprocket wheels 46 at a discharge end of the bed to drive the bed in endless fashion. Preferably, the sprocket wheels 46 are drivingly connected to a sprocket 48 of the metering conveyor by a drive belt 50.

In operation, cut billets are dumped onto a receiving end of the transport conveyor bed and are transported thereby to the metering conveyor 32 where they are scopped-up by the buckets 34. To assure that the buckets 34 are provided with a continuous supply of billets through which to move (and thereby assuredly pick up a full load during each pass therethrough), the transport conveyor constantly urges the billets against the metering conveyor. The bed 40 can travel faster than the stalk mass and "slip" relative thereto, due to the minimal frictional contact occurring between the links 42 and the billets.

A stationary barrier plate 52 is positioned beneath the front end of the transport conveyor 30 to guide falling stalks toward the metering buckets 34.

The metering conveyor 32 is driven at a speed commensurate with the overall separating capacity of the apparatus, so that proper quantities of billets are delivered to the divider station 14.

Stalk Divider Station

Stalks conveyed by the metering conveyor 30 are dropped into the upper end of a chute 60 (FIG. 5) which forms the inlet to the divider station 14. The chute 60 comprises one or more inclined slide ramps 62 which each include an upper end onto which the billets are dropped. Upright side walls 64 (FIG. 7) extend out from opposite sides of the ramps 62. Also extending out from the ramps are one or more divider walls 66 which define the sides of individual billet feeding channels 68A, B, C, D.

It may occur that some of the stalks have not been completely chopped, whereby some of the stalk billets B (FIG. 7) are still partially joined and may thus become hung-up on the upper end of a divider wall 66. To remedy this problem, the upper end 70 of each divider wall is inclined relative to horizontal (FIG. 5) sufficiently to assure that the hung-up billets gravitate to the lower portion thereof. At such lower portion, a rotary-driven cutter wheel 72 is mounted. Each cutter wheel 72 includes cutter blades which travel through an opening in the ramp and a slot in the lower portion of the upper end 70 of the divider wall 66 to cut through the billet-joining component of the stalk.

Accordingly, all billets delivered by the metering conveyor 32 enter one of the feeding channels 68A–D.

The width of each feeding channel is less than that of the length of the billets. In a preferred embodiment, the width of each channel is 5.25 inches and the average billet length is approximately 10 inches. Thus, the billets cannot fall width-wise into the channels, but rather must fall generally lengthwise, i.e., generally aligned with the direction of feed. This produces a first stage of a reorientation of the billets toward a longitudinal orientation. The upper ends of adjacent divider walls are spaced longitudinally relative to one another (FIG. 7) so that any billets which land on a pair of adjacent ends 70 of the divider walls will slide into a feeding channel.

Disposed on each slide ramp 62 is a magnetic element 73 (FIG. 5) to pick up any magnetic metallic materials which may have become intermixed with the billets.

A lower end 74 of each ramp slopes toward the horizontal (FIG. 5) to establish a smooth flow of the gravitating billets onto a delivery conveyor belt 76. The delivery conveyor 76 initially contacts a front end of each billet and thus "pulls" the billets onto the conveyor and thereby produces a longitudinal orientation of any billets not so oriented. A plurality of freely rotatable support rolls 77 are disposed beneath the feeding segment of the delivery conveyor 76. The delivery conveyor includes an inclined portion 79 which moves the stalks upwardly toward the spreading zone 16 in which accumulations or piles of billets are spread-out to assure that billets are not fed while situated atop one another, i.e., that the fed billets are formed into a single layer.

At the spreading station 16 there is provided an endless spreader belt 78 (FIG. 5) traveling around two guide rolls 80, 82, one of which drives the spreader belt 78 in synchronized-speed relationship with the delivery conveyor 76. Each of the rolls 80, 82 is formed of resilient material, such as rubber for example, and is provided with relief holes 84 to increase its elasticity. The relief holes 84 extend longitudinally through the rolls and are formed in radially-spaced, circumferentially overlapping rows. A roll of this type is disclosed in afore-mentioned Tilby U.S. Pat. No. 3,976,498.

The spreader belt 78 is disposed in closely adjacent superimposed relationship to a horizontal portion 85 of the delivery conveyor belt to define a nip therebetween. The belts 76, 78 are disposed such that, if no billets were traveling therebetween, the belts would touch. However, with billets gripped therebetween, the belts are spaced apart, but in tight gripping engagement with the billets to positively advance same.

Located opposite the upstream guide roll is a pressure roll 88 (FIG. 5) over which the delivery conveyor 76 travels. The pressure roll is formed of a relatively unyielding material, such as metal, and is spaced from the adjacent guide roll 80 by a distance generally equal to the combined thickness of the spreader and delivery belts 76, 78. Thus, billets can pass through the nip only upon a deforming of the guide roll 80. It has been found that the nip formed by the spreader and delivery belts 76, 78, the yieldable pressure roll 80, and the unyieldable pressure roll 86 functions effectively to admit only a single layer of billets into the nip. That is, billets which are disposed atop one or more other billets are caused to be pushed back at the nip inlet. The inclined nature of the delivery conveyor 76 at the nip inlet facilitates rearward displacement of such piggy-back billets.

It will be appreciated that there is provided a separate spreader belt in each of the feeding channels 68A-D. The billets are thus caused to travel in single layer fashion between the pair of delivery and spreader belts and are conveyed to a generally horizontal condition upon reaching a discharge end 88 of the nip.

The inlet of the nip should be disposed so as to face the inclined portion of the delivery conveyor, i.e., at the top of the inclined portion or somewhere therealong.

Feeding Station

Figure 2:
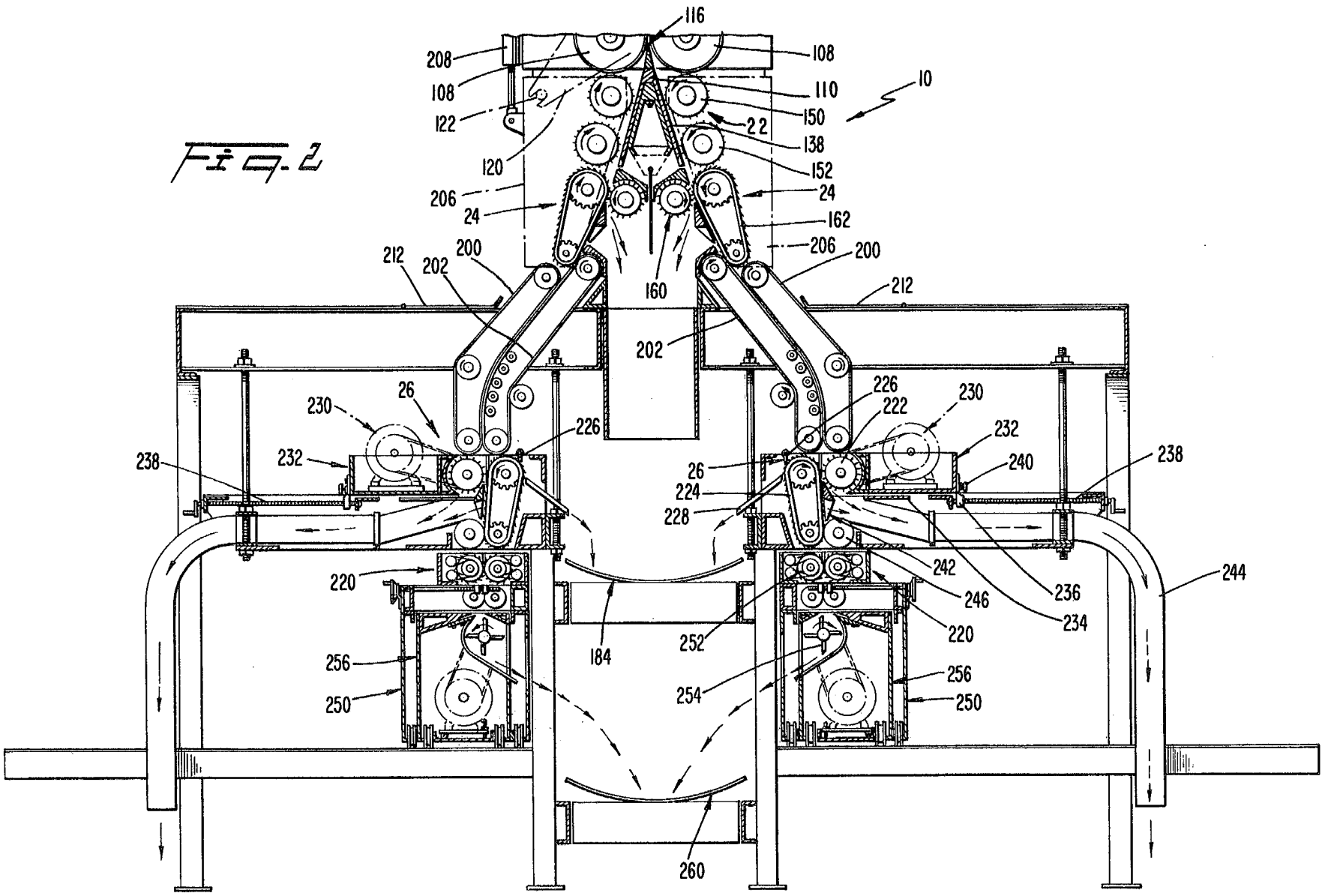
FIG. 2 is a side elevational view of a lower portion of the handling mechanism, with sidewall portions thereof removed to expose the inner mechanism thereof.

Aligned with the horizontal discharge 88 of the nip of the belts 76, 78 in the inlet of the separator feeding station 20. The feeding station 20 is formed by a pair of superimposed endless feeder belts 90, 92 which grip billets therebetween (FIG. 6) and conveys same from a horizontal condition to a vertical condition at the splitter station 22 (FIG. 2). Channel-forming divider walls 94 are disposed between adjacent pairs of feeder belts 90, 92 and are aligned with corresponding upstream divider walls 66.

The upstream end 96 of the lower feeder belt 92 is aligned with the discharge end of the delivery belt 76 (FIG. 5) and spaced therefrom by a distance less than the billet length so that the billets are smoothly delivered onto the lower feeder belt 92. As the billets are thereafter advanced by the lower feeder belt 92, they enter a nip between the feeder belts 90, 92 and are gripped between the feeder belts 90, 92 for a positive advancement. The feeder belts 90, 92 are driven at synchronized speed so that the longitudinal orientation of the billets is maintained. The billet-contacting surface 98 of the upper feeder belt 90 is of a roughened texture to increase the gripping action. The billet-contacting surface 100 of the lower feeder belt 92 is of a similar roughened nature or may contain short, sharp tines which penetrate the billets to augment the positive feed.

Figures 5, 6, 7, 8, 9, 10:
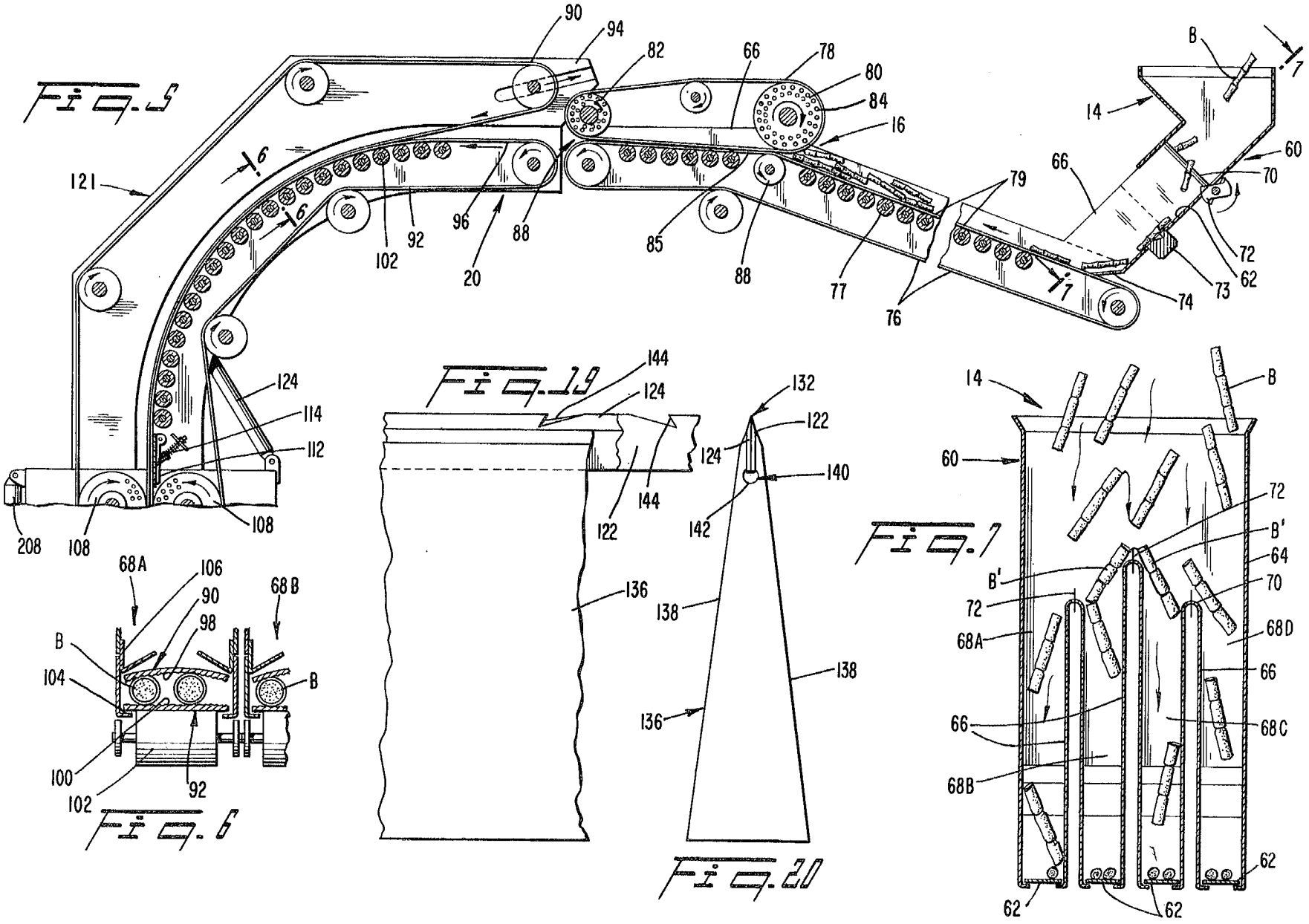
FIG. 5 is a side elevational view of an upper portion of the stalk handling mechanism, with sidewall portions thereof broken away to expose inner components thereof.
FIG. 6 is a partial cross-sectional view taken along line 6—6 of FIG. 5.
FIG. 7 is a cross-sectional view taken along line 7—7 in FIG. 5.
FIG. 8 is an enlarged fragmentary view of a pith-removal station of the stalk handling mechanism.
FIG. 9 is a view taken in the direction of line 9—9 of FIG. 8.
FIG. 10 is a cross-sectional view taken along line 10—10 of FIG. 9.
Figure 8:
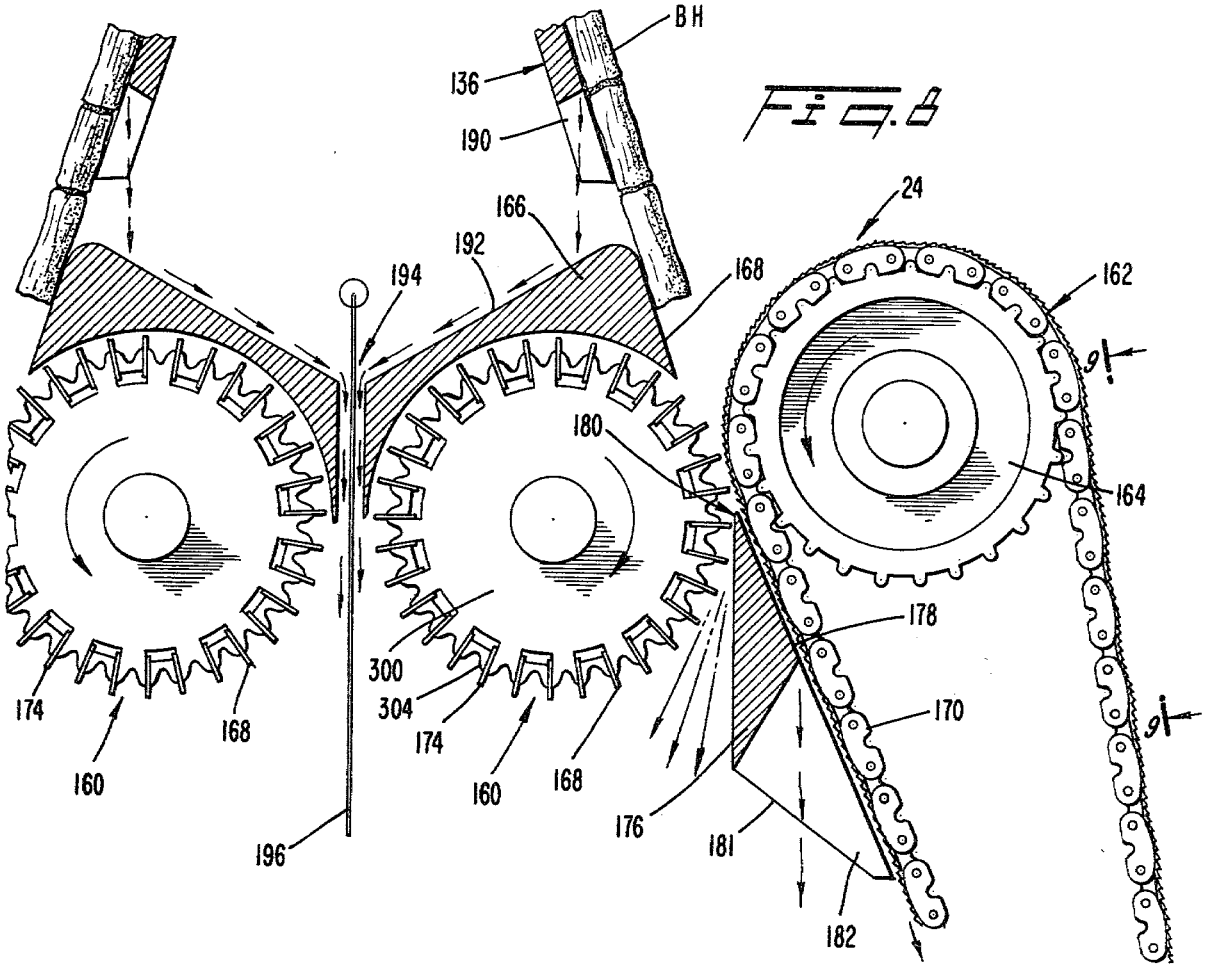
Figure 9:
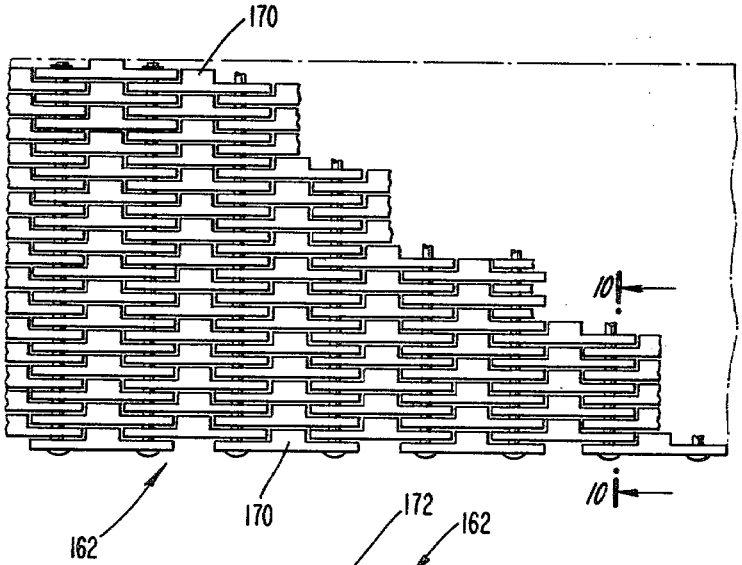
Figure 10:
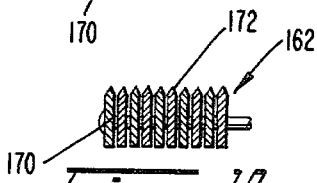

A series of freely rotatable support rollers 102 (FIG. 5) is disposed beneath the feeding segment of the lower feeder belt 92 along the horizontal-to-vertical transition zone of the latter. Due to the presence of the support rollers 102, the lower feeder belt 92 is constrained against deflection. The upper feeder belt 90 thus deflects when billets are gripped therebetween (FIG. 6). Lower edges 104 of the channel-defining walls 94 (FIG. 6) are bent toward one another in underlying relation to the lower feeder belt 92 to form support lips for outer edges of the lower feeder belt 92 to prevent billets from passing beneath the latter. Angled rails 106 are disposed above the edges of the upper feeder belt 90 to prevent billets from passing above the latter.

At a discharge end of the nip of the feeder belts 90, 92, the belts are wrapped around synchronously-driven rolls 108 of a construction similar to the rolls 80, 82 which support the spreader belt 78 (FIGS. 2 and 5). The guide rolls 108 are resiliently deformable to automatically adapt to billets of different size. Those guide rolls 108 are disposed on opposite sides of a splitter device 110 such that the feeder belts 90, 92 continue to impose a positive feeding action on all billets at the point of contact with the splitter device 110, regardless of the lengthwise dimension of the billet.

The nip of the feed conveyors 90, 92 extends continuously to the splitter 110 from the discharge end of the delivery conveyor 76, which may be considered as a stalk receiving zone for the feed conveyors. There thus occurs no hiatus between the discharge end of the feed conveyor, and the splitter in which the billets could become skewed or angled relative to the longitudinal feed direction.

A vertical backing plate 112 is provided behind the lower feeder belt 92 upstream of the guide rolls 108 (FIG. 5). The backing plate is yieldably biased toward the lower feeder belt 92 by a spring 114. In the event that a relatively large-diameter billet approaches the guide rolls 108, the backing plate 112 yields to enable such billet to become aligned with the discharge end of the nip of the feeding belts 90, 92. The upper feed conveyor is mounted on a movable frame 121 which is pivotably mounted at 122 (FIG. 2) to a stationary frame 124 of the separator. One or more fluid actuated rams 124 are pivotably connected between the stationary frame and the movable frame to swing the movable frame about the pivot 122 in order to separate the feeder belts 90, 92 for maintenance and repair.

Splitting Station

The splitting device 110 may comprise a sharpened stationary blade including a cutting edge 116 (FIG. 2) extending laterally across the direction of billet travel. Although a stationary blade performs adequately, there may be occasions where the billets are mixed with considerable trash, such as leaves for example, which tend to hang-up on a stationary blade. If excessive trash builds-up on the blade, the separator must be stopped, opened, and cleared.

To resolve this problem, an alternate type of splitter 120 (FIGS. 18 and 19) according to the present invention comprises a pair of oppositely traveling endless cutter bands 122, 124. Each band is wrapped around a plurality of rolls 126, 128, one of which 126 is driven. The bands are arranged such that cutting sections 130 thereof are disposed in side-by-side relationship and travel in opposite directions. The splitter 120 is arranged such that upper beveled edges 132 of the bands lie back-to-back to effectively define a cutting edge. The splitter 120 is disposed such that the cutting sections 130 of the bands travel laterally across the direction of billet travel.

Each band travels laterally through all of the billet feed channels 68. FIG. 18 depicts a case where two feed channels 68A, B are provided which are separated by a divider wall 134 that extends throughout the height of the splitting station 22 and pith milling station 24. In each feed channel there is disposed a rind guide member 136 having downwardly diverging billet support surfaces 138 and an upper slot 140 through which the bands 122, 124 travel. The bands 122, 124 pass through an opening in the divider wall 134 and travel through both guide members 136. The bands travel atop a replaceable insert 142 (FIG. 20) disposed at the bottom of the opening and guide members, the insert 142 formed of a relatively soft material, such as bronze for example, which minimizes wear of the bands. When the insert 142 wears out, it is replaced. Upper portions of the guide members 136 are beveled generally to the level of the bands.

The cutting edges 132 of the bands include notches 144 which aid in cutting trash such as leaves. That is, leaves which are pushed against the bands by the force of billet flow are snipped off by the oppositely traveling, oppositely facing notches.

The feed belts 90, 92 propel the billets downwardly in longitudinal orientation against the cutting edge 116 or 132 such that each billet is split longitudinally in half (FIG. 2). The billet halves slide downwardly along the support surfaces 138 of the guide member 136. A plurality of driven transport rolls 150, 152 are disposed in closely spaced relation to each support surface 138. The transport rolls 150, 152 are resilient and are preferably similar to those 80, 108 around which the spreader belts 78 and feed belts 90, 92 are wrapped. In addition, such transport rolls may contain pointed tines projecting from their outer peripheries. The transport rolls 150, 152 are adjustable toward and away from the associated guide surface and may be adjusted so as to act only upon thicker billet sections. In this regard, it has been found that billets of smaller diameter pass relatively easily into the nip of the pith removal station 24 (to be discussed hereafter), whereas larger diameter billets do not enter such nip easily. Thus, the added impetus afforded by the downstream transport roll 152 serves to push the billets into the nip. The upstream transport roll 150 aids in feeding the larger billets and also functions as a shield to deflect outwardly sprayed pith or juice back toward the support surface.

At this point it should be noted that the apparatus for handling both billet halves are identical, such as transport rolls, pith removal stations, epidermis removal stations, etc., and thus, the apparatus for handling only one of the billet halves will be described in detail.

Pith Removal Station

Split billet halves BH (FIG. 8) exiting the support surfaces 138 enter the pith milling station 24 which comprises a driven milling roll 160 and a driven hold-back track 162. The milling roll 160 is located opposite the upper end of the hold-back track 162 and, in particular, opposite a drive sprocket wheel 164 of the track 162. The milling roll 160 and hold-back track 162 define a nip therebetween which receives the billet halves. An intermediate support element 166 is disposed intermediate a discharge end of the support surface 138 and the milling roll 160 to define a short guide surface 168 along which the billet half travels toward the nip.

The milling roll 160 and hold-back track 162 are driven through the nip in the same direction but at different speeds. In this regard, the milling roll 160 is driven at high speed, whereas the hold-back track 162 is driven at a slower speed. The hold-back track 162 acts upon the billet half to control the speed thereof and assure that the tip speed of cutting blades 168 of the milling roll 160 is faster than the speed of billet travel. Accordingly, the blades pass through the pith component of the billet to scrape such pith from the rind component.

The hold-back track 162 is formed of interconnected links 170 (FIG. 9) which are formed with rearwardly raked teeth at their outer edges, i.e., the teeth are inclined in a direction away from the direction of billet travel through the nip.

The hold-back track 162 is spaced from the tips of the milling blades 168 by an amount less than the normal thickness of the rind component of the billet half, whereby the billet half is flattened as it passes through the depithing station 24. That is, the hold-back track 162 presses against one side of the rind and flat outer faces 174 of the milling blades 168 push against the other side of the rind portion as pith is being scraped away. Accordingly, the rind is compressed by such oppositely acting forces to facilitate pith removal.

As a billet half enters the nip, its pith component is immediately contacted by the rapidly driven milling blades 168. The tendency for the billet half to be advanced at the same speed as the tip speed of the milling blades is resisted by the slower traveling hold-back track 162 whose inclined teeth 172 positively grip the rind portion of the billet half. Consequently, the milling blades 168 pass rapidly through the pith, scraping it from the rind.

Located immediately downstream of the milling roll is a guide member 176 (FIG. 8) having a rind support face 178 along which the rind travels after being depithed. The hold-back track 162 propels the rind along the entire extent of the guide face 178. It has been found that superior results are attained by orienting the support surface 178 at a slight angle, e.g., six degrees, relative to an extension of the upstream support surface 138. Such inclination serves to prevent the teeth 172 of the hold-back links 170 from ripping the rind as the links move off the sprocket 164.

The hold-back track 162 provides certain advantages over a previously employed hold-back device in the form of a single tined roll (see afore-mentioned Tilby U.S. Pat. No. 3,976,498). For example, in the case of a single hold-back roll, hold-back action was imposed on the billet half along only a line parallel to the roll axis. On occasion that hold-back action would be overcome by the forces of the milling blades, causing the billet half to be prematurely driven from the depithing station before depithing was completed. The hold-back track 162, however, imparts a hold-back action on the billet half along an extended surface, thereby preventing premature discharge of the billet half.

In addition, the hold-back track prevents the accumulation of rind fibers upon a nose portion 180 (FIG. 8) of the guide member 176 which tends to occur. In this regard, rind fibers can become hung-up on such nose portion 180 which in previous separators was located immediately downstream of the hold-back roll. However, the hold-back track 162 according to the present invention is disposed opposite the nose and functions continually to remove rind fibers from the nose. The hold-back track thus eliminates the need for a fiber removal roll described in afore-mentioned Vukelic U.S. Pat. No. 4,151,004. Furthermore, the hold-back track effectively covers the area downstream of the milling roll 160 and thus acts as a shield to prevent the loss of pith or juice which is sprayed from the milling roll 160. That is, such sprayed material is now deflected back toward the rind guide member 176.

The downstream part of the rind guide member 176 is formed by spaced fingers 181 (FIG. 8) which define juice escape slots 182 therebetween. That is, juice or pith material traveling along the rind support surface 178 passes inwardly through the slots and is collected on a pith-receiving trough 184 (FIG. 2).

Similar slots 190 (FIG. 8) are provided at the downstream end of the billet guide member 136 for a similar purpose. Pith and/or pith juice passing through the slots 190 is directed onto a surface 192 of the intermediate support element 166 and gravitates to a discharge passage 194. A flexible baffle plate 196 extends downwardly through that passage to prevent pith cut by one milling roll from being thrown onto the adjacent milling roll.

Upon discharge from the pith removal station 24, the depithed rind segments are gripped between a pair of opposing conveyor belts 200, 202 (FIG. 2) which grip the rind segments therebetween and transport the segments downwardly while reorienting them to a generally vertical condition.

The transfer rolls 150, 152 (FIG. 2) and hold-back track 162 are mounted on a pivotably mounted wing section 206 of the separator which is pivoted at 122 to the stationary separator frame. A fluid actuated ram 208 is connected between the stationary frame and each wing section 206 to swing the latter outwardly to expose the interior of the separator.

The outer one 200 of the conveyor belts 200, 202 is mounted on a frame 210 which can be swung open (FIG. 1). A swingable arm 212, normally disposed in a position preventing the frame 210 from opening, can be swung away therefrom to allow the frame 210 to be opened.

It will be appreciated that the respective feed channels 68 (FIG. 6) of the separator are divided by divider walls which extend from the splitter to the lower end of the pith removal station. Additional divider walls continue thereafter. It should be noted that each divider wall extends continuously from the divider station 14 all the way to the end of the epidermis milling station 26 and may be formed of one piece or separate pieces which are aligned and interconnected (e.g., by a tongue and groove connection, for example).

Epidermis Removal Station

Rind segments discharged from the conveyor belts 200, 202 may, if desired, be fed to an epidermis removal station (FIG. 2). The epidermis removal station comprises a milling roll 222 and a hold-back track 224 which function in a manner similar to the corresponding components 160, 162 of the pith-removal station 24 and thus will not be discussed in detail. The milling roll and hold-back track of the epidermis removal station are reversed relative to the pith-removal station since the epidermis is located on the side of the rind opposite the pith.

A scraper 226 (FIG. 2) is provided for scraping pith material from the hold-back track 224, which pith material is acquired through contact of the hold-back track and the pithy side of the rind segments. Pith which is scraped-off is transferred onto a chute 228 which conducts the pith to the pith removal trough. The hold-back track 224 is mounted on a stationary portion of the separator frame, whereas the milling roll 222, along with its drive motor 230, is mounted on a movable head 232. The head comprises a carrier which is slidable along a fixed plate 234. A threaded collar 236 is mounted to the carrier and is displaceable along a threaded control rod 238. The control rod 238 is rotatably held in the fixed plate 234 and is rotatable by means of a handle in order to reciprocate the head 232. In so doing, the milling roll 222 is moved toward and away from the hold-back track 224 to facilitate maintenance of those elements. The head 232 is secured to the collar by means of a quick-release feastener 240, the removal of which enables the entire head 232 to be removed and replaced as a unit.

Immediately downstream of the milling roll 222 there is disposed a rind guide member 242 (FIG. 2) having slots therein similar to those discussed earlier. Epidermis which is milled-off by the molling roll 224 is conveyed away by means of a pneumatic suction apparatus (not shown).

After being stripped of epidermis, the rind sections are discharged from the epidermis removal station from between the downstream end of the hold-back track and an opposing pressure roll 246.

Shredder Unit

Aligned with the discharge of the epidermis removal station is the inlet of the shredder unit 220 (FIG. 2). The shredder unit is mounted for movement on a wheeled frame 250 and includes a plurality of axially adjacent, radially overlapping shredder discs 252 which split the rind segments into narrow strips. A rotary chipper wheel 254 can be positioned beneath the shredder to chip the strips, if desired. If not desired, the chipper is easily removed by sliding it away on its own wheeled frame 256. Rind which is split and/or chopped, or neither, is conducted onto a rind removal chute 260.

Milling Roll

As the separator is being used, there will occasionally occur the need to resharpen the milling blades of the milling rolls 160 and 222 (FIG. 2). The blades are preferably of rectangular configuration and are reversible whereby the four longitudinal edges 290 (FIG. 12) of the blade may each constitute a cutting edge when properly oriented on the roll. It will be appreciated that the spacing between the outer end of the milling blades and the associated hold-back track at the pith and epidermis milling stations is crucial and requires a high degree of precision. It will also be appreciated that after the blades have been reground a number of times, the dimensions and/or configuration of the blade are changed. This can be especially true if the regrinding operations are performed by unskilled laborers, as may often be the case. Accordingly, it is necessary to assure that upon reinsertion onto the roll, the blades are positioned such that the cutting edge is returned precisely to its original location and orientation.

Figure 14:
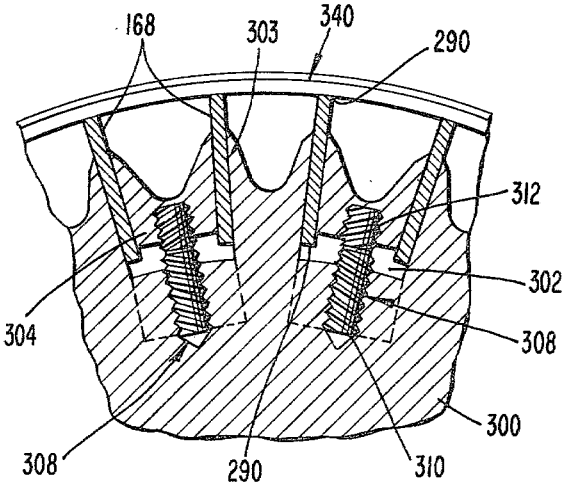
FIG. 14 is a partial cross-sectional view taken along line 14—14 of FIG. 12.

Accordingly, each milling roll 160, 222 comprises a hub 300 (FIGS. 11–14) having at least one row 301 of longitudinally extending, circumferentially spaced grooves 302 (FIG. 14) on its outer periphery. Preferably, there are a plurality of axially spaced rows 301A–D as will be explained hereafter. The grooves 302, defined by rigid longitudinal ribs 303 of the hub 300, are radially outwardly open and extend parallel to the longitudinal axis of rotation of the roll. Each groove 302 is arranged to receive two circumferentially spaced blades 168A, B separated circumferentially by a set of aligned fixing wedges 304. Each groove is bordered by two radially extending side walls 306 defined by adjacent ribs 303 against which the baldes 168A, B rest. The wedges 304 are positioned between the blades 168A, B and are tightened by means of retainer screws 308 which project through the wedges and are threadedly received within threaded holes 310 in the base of the groove 302. Each screw has a threaded upper portion 312 which is received in a threaded opening of the wedge 304 and a threaded lower portion 314 received within the holes 310. The threads of the upper and lower portions 312, 314 of the screw are mutually reversed, so that when the screw 308 is rotated for removal from the hole 310, the upper threads positively urge the wedge outwardly of the groove 302. This aids in removal of the wedges. Each screw 308 includes a socket at an upper end which receives a suitable turning tool such as an Allen wrench or the like.

Situated at opposite ends of the groove 302 are a pair of adjustment elements 320 (FIGS. 13–14) which define the radial support for the blades 168A, B of that groove. Each adjustment element 320 is cup-shaped, including a disc portion 322 and a cylindrical skirt portion 324. The elements 320 are seated within cylindrical recesses 326 in the base of the groove 302, with the skirt portion 324 facing radially outwardly. Extending through a threaded hole in the disc portion 322 of each element is an adjustment screw 328 which is threadedly coupled within the hole. The radially inner end 330 of the screw 328 is somewhat rounded and bears against the floor 332 of its recess 326, and the radially outer end 334 of the screw 328 includes a socket (not shown) for receiving a suitable turning tool. It will be appreciated that by turning the adjustment screw 328, the element 320 can be displaced radially outwardly. Baldes 168A, B disposed within the groove rest upon the skirt portions 324 of the pairs of elements 320 and will also be displaced radially outwardly.

Figure 11:
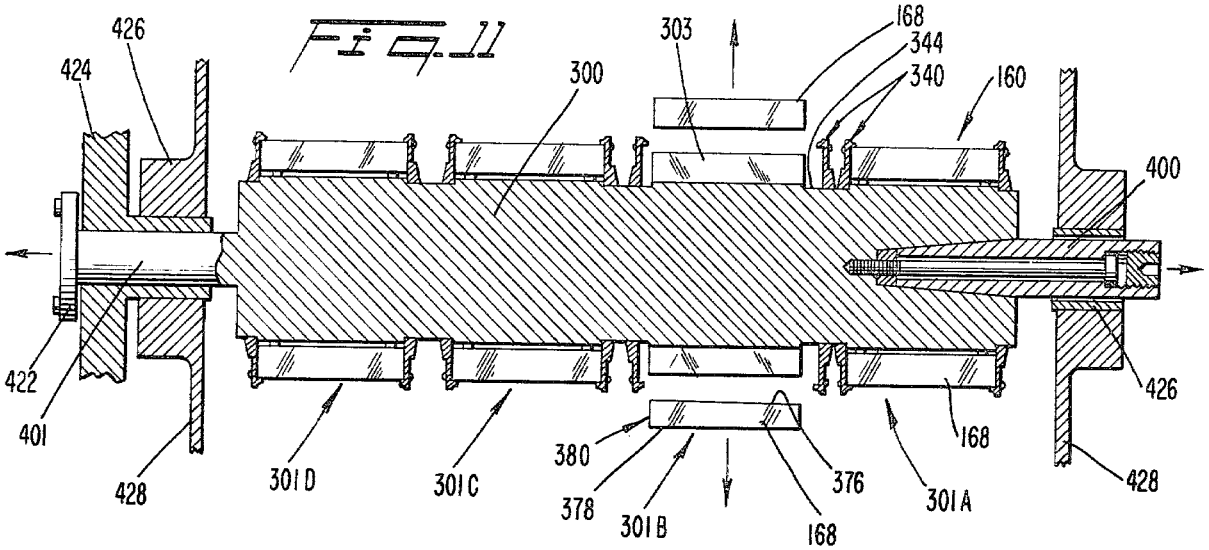
FIG. 11 is a longitudinal sectional view taken through a milling roll according to the present invention.

In order to define a desired radial position of the blade cutting edge, a pair of gauge rings 340, 342 (FIG. 12) are disposed in annular channels 344, 346 of the hub 300 at opposite ends of the groove 302. Each pair of gauge rings 340, 342 are associated with a given one of the circumferential rows 301A–D of blades (FIG. 11). Each gauge ring is of three pieces and includes a two-piece inner portion 348 and a one-piece outer portion 350. If desired, the inner portion 348 may be formed of more than two pieces, but the outer portion 350 is most preferably of one piece. The inner portion 348 comprises two semi-circular segments 351 (only one shown) which can be brought radially together into the channel to form a continuous annular member. Inner surfaces 352 of the segments of the inner portion 348 rest upon a shoulder 354 of the hub. The one-piece outer portion is positionable within recesses 355 of the segments of the inner portion, and is attachable to both segments of the inner portion 348 by means of screws 356 so that the segments of the inner portion 348 and the outer portion 350 constitute a unitary structure.

The inner diameter of the outer portion 350 is sufficiently large to enable the outer portion 350 to be slid axially along the hub 300 and over the ribs 303.

An annular lip 358 projects laterally outwardly from the edge of the outer portion 350 to define a positioning stop for the cutting edges of the associated circumferential row of blades. That is, the ends of the cutting edges 290 can abut the lips 358 of adjacent gauge rings and in so doing, become oriented parallel to the rotary axis of the roll and at a proper radial distance therefrom.

Figure 12:
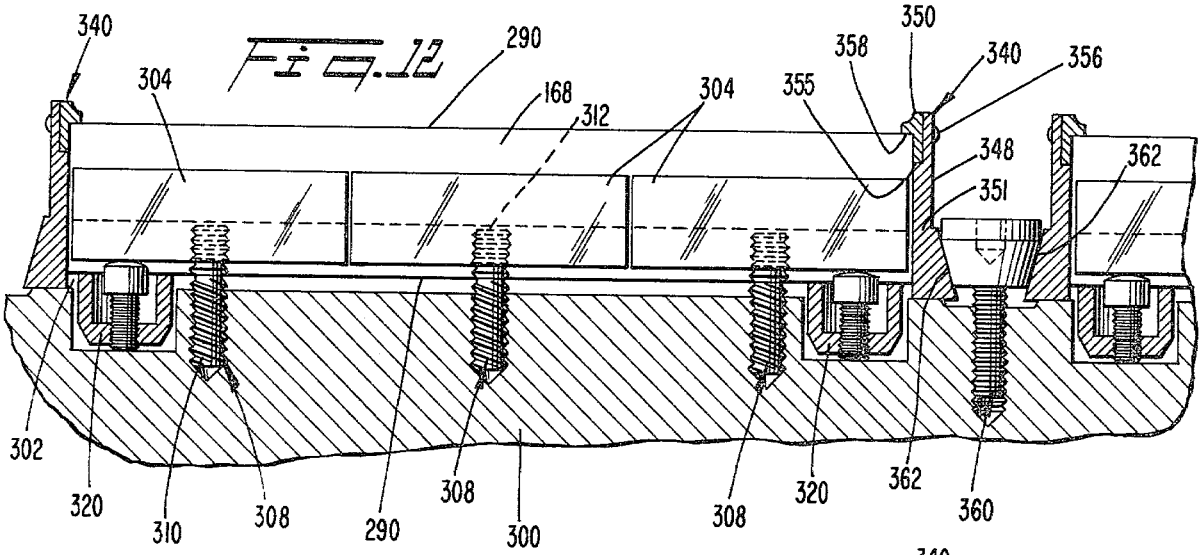
FIG. 12 is an enlarged fragmentary view of a portion of the milling roll.
Figure 13:
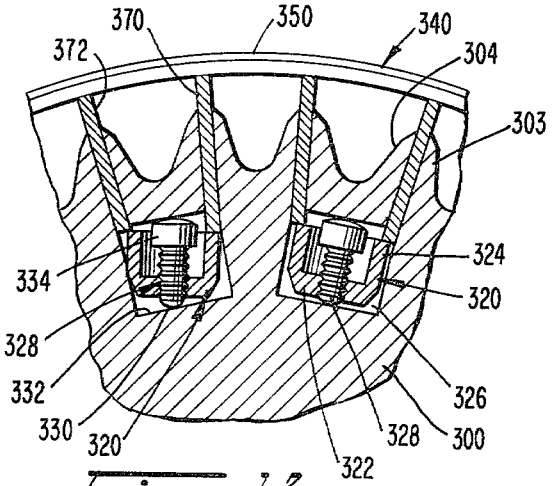
FIG. 13 is a partial cross-sectional view taken along line 13—13 of FIG. 12.

In practice, the milling roll can be assembled by first installing the gauge rings 340 within the respective channels 344, 346. This is performed by bringing together the semi-circular segments 351 of the inner portion 348 within the associated channel, sliding the one-piece outer portion axially along the hub, positioning the outer portion 350 into the recesses 355 in the segments 351, and securing the screws 356 to connect the outer portion to both inner segments 351. The blades 168A, B of a given circumferential row 301A are inserted within their associated grooves 302, with the wedges 304 then secured only semi-tight. The gauge rings 340 are moved axially against the axial ends of the blades and/or ribs 303. This is accomplished, for example, by attaching cap screws 360 to the hub 300 between adjacent gauge rings 340 disposed back-to-back (FIG. 12). The cap screws each include a tapered head 362 which wedges between tapered walls of the inner portion 348 of the gauge rings to displace the gauge rings axially.

Thereafter, by means of a turning tool, the adjustment screws 328 of the adjustment elements 320 are turned in order to displace the elements radially outwardly. Accordingly, the skirt portion 324 of each element contacts its associated blades and pushes the latter radially outwardly until the outer cutting 290 edge of one of the blades (e.g., blade 370 in FIG. 13) contacts the positioning lip 358 of the adjacent gauge ring 340. In response to continued turning of the same adjustment screw 328, the element 320 and the screw 328 tilt about a fulcrum defined by the already positioned blade 170 (i.e., clockwise as viewed in FIG. 13), thereby continuing to displace the other blade 372 radially outwardly until it, too, contacts the positioning lip 358. This procedure is repeated on the element 320 at the other end of the same groove 302 so that both ends of the cutting blades 370, 372 contact the positioning lips 358 of the two gauge rings associated therewith. With this accomplished, it is assured that the cutting edge of each blade 370, 372 is properly located parallel to the rotary axis at a fixed distance therefrom. It will be appreciated that blades 370, 372 within the same groove which are of different radial dimension (i.e., compare the blades 370, 372 of FIG. 13 wherein the blade 372 is of shorter radial dimension than the adjacent blade 370 of the same groove as a result of having been reground a greater number of times) can be accurately positioned by the elements 320. Moreover, this can be achieved even though the cutting edges of the blades are no longer parallel (compare the edges 376, 378 of a blade 380 in FIG. 11), because the elements 320 contact both ends of the blade.

Once the blades are properly oriented, the wedges 304 are fully tightened to securely fix the blades in place.

The cap screws 360 which displace the gauge rings axially are required for those gauge rings located intermediate the ends of the hub. The end-most gauge rings can be positioned merely by an annular projection on the hub or, alternatively, cap screws can also be provided therefor.

By employing a three piece gauge ring 340, the provision of a precisely located stop lip 358 is facilitated. That is, if the outer portion 350 of the gauge ring were to be formed of two pieces, integral with respective segments 351, there would exist the danger that the shoulder surfaces of the lip parts would not become precisely aligned, thereby creating the same misalignment of the cutting edge. However, the one-piece construction of the outer portion 350, avoids that problem. Of course, if the entire gauge ring were formed of one-piece, difficulty would exist in installing such piece axially over the ribs 303.

As noted earlier, each rectangular blade 168 comprises four longitudinal edges 290, each edge constituting a separately usable cutting edge. Thus, at the end of one cutting sequence, the entire milling roll 160 is reversed in order to orient a different cutting edge of each blade in cutting position. After the ensuing cutting sequence, the individual blades are inverted or reground.

It should also be noted that a single milling roll functions to service more than one feed channel. That is, the milling roll may contain more than one circumferential row of blades (note the rows 301A–D in FIG. 11), each circumferential row being located to cut the billets of a given feed channel. In this regard, the divider walls which separate the feed channels extend to a location closely adjacent the area between adjoining rows of blades.

Journal Bearing for Rolls

Since the various drive sockets, transport rolls, pressure rolls, milling rolls, etc. of the separator must eventually be removed for servicing or replacement, it is desirable that they be removable easily and quickly to minimize the down-time of the apparatus. Accordingly, a quick-release journal assembly has been devised which constitutes an improvement over that disclosed in aforementioned Tilby U.S. Pat. No. 3,976,498. In accordance with the present invention, a pair of journals 400, 401 rotatably mount a roll 406 (FIGS. 11 and 15–17). Each journal is provided with a tapered end 402 (FIG. 15) which is to be received in a correspondingly tapered opening in a hub 406 of the roll. An axial bore 408 through the journal 400 receives, with slight clearance, a connector bolt 410 which is releasably threadedly coupled to a recess 412 at the inner end of the opening 404. The head 414 of the connector bolt is mounted within an enlarged chamber 416 in the journal 400 and includes a socket 418 for receiving a suitable turning tool.

The chamber 416 is internally threaded and normally threadedly receives a plug 420 which closes-off the chamber. One of the journals 401 (FIG. 11) is provided with a flange 422 which bolts onto a drive wheel 424 to transmit rotary motion to the roll. Both journal members 400, 401 are rotatably mounted in bearings 426 carried by stationary frame parts 428.

The roll is normally released by removing the plug 420, unscrewing and removing the connector bolts 410, and removing the journals 400, 401 from the openings 404 in the roll. This enables the roll to drop out from between the frame parts 428. It may occur, however, that the journal(s) becomes stuck within the opening, due to the wedging action. When this occurs, the ensuing procedure is followed in accordance with the present invention. With the plug 420 removed, the connector bolt 410 is only partially unthreaded (FIG. 16). Thereafter, a slug 430 (FIG. 17) is inserted into the chamber (the use of this slug is optional—to protect the head 414 of the connector bolt 410) and an extractor bolt 432 is threadedly inserted into the chamber 416. By tightening the extractor bolt 432 against the head 414 of the connector bolt (via the slug 430) and further rotating the extractor bolt 432, the threaded engagement between the extractor bolt 432 and the chamber 416 causes the journal 400 to be forcefully pulled in an axially outward direction to be freed. It should be noted that the threaded shank of the extractor bolt 432 is sufficiently long to assure that the head 434 of the extractor bolt does not contact the journal 400.

In the event that the above-recited steps fail to free the journal, a draft pin (not shown) may be inserted through an axial passage 436 in the extractor bolt and placed in engagement with the slug 430. Thereafter, a light tap upon the draft pin may release the journal.

In an unusual circumstance where all of the above-recited steps prove fruitless, high pressure grease may be applied to release the journal. In this regard, a grease fitting (not shown) is screwed into a threaded hole 438 in the head 434 of the extractor bolt 432 and grease is forced through the passage 436 of the extractor bolt, through a lateral passage 439 in the slug 430, through the clearance between the connector bolt 410 and the axial bore 408 of the journal member, and into the opening 404 of the roll behind the inner end 440 of the journal member. Thus, the grease reacts against the inner end 440 of the journal member to push the latter from the opening.

In operation, plant stalks which are to be separated are chopped into short billets B and are deposited onto the transport conveyor 38 (FIG. 3). The transport conveyor conveys the billets, in a randomly oriented condition, horizontally against the metering conveyor 32 such that a supply of billets is continuously maintained in forced relationship against the metering conveyor. The continually buckets 34 of the metering conveyor pass through the billets, picking up a charge of such billets while so doing. If the transport conveyor travels at a faster rate than the billets, as may occur when the billets are forced against the metering conveyor, the transport conveyor is easily capable of slipping relative to the mass of billets. The buckets deposit the billets into the upper end of the chute 60 at the divider station 14 (FIGS. 5 and 7). The metering conveyor is driven at a speed commensurate with the desired separating capacity of the unit. This capacity will be determined in part by the number of billet conducting channels 68 extending through the unit. Billets which have not been completely chopped and which become hung-up on the upper end of a divider wall 66 in the chute gravitate to the lower portion thereof and are cut by the cutter blade 72 associated with that divider wall.

The billets fall generally length-wise onto the slide ramp 62, (FIGS. 5 and 7) of the chute and gravitate downwardly onto the receiving end of the delivery conveyor belt 76. The delivery conveyor initially contacts a front end of each billet and thus "pulls" the billets onto the conveyor, thereby producing a longitudinal orientation (i.e., parallel to the longitudinal direction of travel of the billets) of any billets not already longitudinally oriented. The delivery conveyor transports the billets upwardly toward the spreading zone 16 at which accumulations or piles of billets are spread-out longitudinally (i.e., "surges" are eliminated) to assure that the billets form a single layer as they pass through the nip between the spreader belt 78 and the delivery conveyor belt 76.

The billets are fed from the delivery conveyor to the inlet of the superimposed endless feeder belts 90, 92 (FIG. 5) which grip the billets therebetween and convey same from a horizontal condition to a vertical condition at the splitter station 22 (FIGS. 2 and 18). The feeder belts positively grip and advance each billet during its entire extent of travel against the splitter mechanism 120 which splits the billets longitudinally in half. It is thus assured that none of the billets are allowed to free-fall against the splitter mechanism and become thereby skewed.

Billets are split by the cutting edge defined by the oppositely traveling portions of the cutter bands 122, 124 (FIG. 18). Any leaf trash which is conducted along with the billets, is effectively cut by the oppositely traveling, oppositely facing notches 144 (FIG. 19) of the cutting bands.

The billet halves slide downwardly along the support surfaces 138 of the guide member 136 (FIGS. 19–20) on their way to the pith removal station 24. The transport rolls 150, 152 aid in guiding the billet halves, as well as propelling the thicker billet halves.

Upon reaching the pith removal station 24 (FIG. 8), the billet halves enter the nip formed by the rotary milling roll 160 and the slower traveling hold-back track 162. The rearwardly raked projections 172 of the hold-back track pierce the rind portion of the billet halves, enabling the hold-back track to control the speed of the billet halves, whereby the blades 168 of the milling roll pass through the billet halves and mill-away the pith component thereof. The pith and pith juices travel inwardly and downwardly onto the pith removal chute 184. The hold-back track extends downstream beyond an upstream end 180 of a guide member 176 to maintain such upstream end free of fibers.

Billet halves exiting the pith removal station 24 are fed downwardly by the conveyors 200, 202 to the epidermis removal station 26 (FIG. 2). The hold-back track 224 controls the speed of the billet halves as the milling roll 222 mills-away epidermis from the rind. The removed epidermis is conveyed away by means of the pneumatic conveyor 244. Pieces of rind exiting the epidermis removal station pass through the shredder 252 and the chopper 254 and are eventually deposited onto the rind removal chute 260.

When the cutting edges 290 of the milling blades 168 become dull, the milling rolls of the pith removal station and epidermis removal station are removed and reversed, such that new edges of the blades 168 constitute the cutting edges. When those edges also become dulled, the blades 168 are removed and resharpened. The resharpened blades are inserted into the milling roll (FIGS. 11–14) by being inserted in pairs into a groove 302. The wedges 304 are lightly secured and the cap screws 362 are connected to push the guide rings 348 against opposite ends of the blade. The screw 334 of one of the adjustment members 320 is rotated until the adjustment member contacts one of the blades 370 (FIG. 13) and pushes same into engagement with the shoulders 358 of the guide rings 340. Thereafter, the adjustment member pivots about such point of contact with the blade and engages the other blade 372 and pushes same into contact with the shoulders 358. Finally, the wedges 304 are tightened by means of the screws 308.

Removal of the blades 168 is achieved in a reverse manner. When the screws 308 are unscrewed, the upper thread portion 312 thereof, positively displaces the wedges outwardly to aid in releasing them from a wedged condition with the blades 168.

If a journal 400 (FIGS. 15–17) becomes jammed within the opening of its associated roll 406, the fastening bolt 410 is slightly backed-off, and the extractor bolt 432 is installed and is screwed-in until further movement is resisted by the head 414 of the fastening bolt 410. Thereafter, further screwing-in of the extractor bolt results in such bolt pushing off from the fastening bolt 410 and pushing against the journal 400 to release the same from the roll.

The present invention provides a separator which positively feeds stalks against a splitter by endless conveyors to eliminate the problem of stalks becoming skewed before reaching the splitter.

A stalk splitter mechanism formed of a pair of oppositely moving endless bands having notches serves to assure that leaf trash will be cut and will not build-up at the splitter.

The use of endless hold-back track assures that ample hold-back forces are imposed on stalk sections being milled, and serves to clear fibers from the guide member disposed downstream of the pith milling roll.

The milling roll according to the present invention assures that even unskilled workers can quickly and easily reverse and replace the milling blades such that the cutting edges are properly located and oriented.

The method of releasing a stuck journal according to the present invention is more simple and convenient than those previously relied upon.

Although the invention has been described in connection with preferred embodiments thereof, it will be appreciated by those skilled in the art that additions, substitutions, modifications, and deletions not specifically described may be made without departing from the spirit and scope of the art as defined in the appended claims.

What is claimed is:

1. In a stalk separator of the type comprising stalk splitting means, feeding means for advancing plant longitudinally oriented stalks longitudinally against cutting edge means of said splitter means to split the stalks longitudinally into sections, and means for removing at least a pith component from each stalk section, the improvement wherein said feeding means comprises a pair of endless conveyors including mutually facing, parallel stalk gripping sections disposed on opposite sides of said splitter means, said gripping sections together defining a stalk-conveying nip extending at least as far as said cutting edge means so that the stalks are positively advanced through said cutting edge means.

2. Apparatus according to claim 1, wherein said conveyors are disposed above said cutting edge which faces upwardly, said stalk gripping sections of said conveyors each including contiguous horizontal and vertical portions, said horizontal portions extending to a stalk-receiving zone, and said vertical sections extending from said horizontal sections to said cutting edge means.

3. Apparatus according to claim 2, including a pair of resilient guide rolls disposed on opposite sides of said splitter means, said conveyors extending around said resilient rolls.

4. Apparatus according to claim 3, including a backing plate disposed behind one of said conveyors just upstream of said guide rolls, said plate being yieldably urged against said one conveyor.

5. Apparatus according to claim 1, wherein said stalk splitting means comprises at least one endless band having a sharpened edge with notches.

6. Apparatus according to claim 1, wherein said stalk splitting means comprises a pair of endless bands each having a sharpened edge with notches; means mounting said bands such that portions thereof travel adjacent one another such that said edges engage one another to define said cutting edge means; and means driving said bands such that said portions travel in opposite directions.

7. Apparatus according to claim 1, wherein said pith removing means comprises a bladed milling roll, a hold-back member in the form of an endless belt having outwardly projecting tines, and a stationary stalk support surface disposed downstream of said milling roll along which a depithed stalk section travels, said belt including a stalk contacting portion facing said milling roll to define a nip therebetween for receiving stalk sections, said stalk contacting portion of said hold-back conveyor extending beyond an upstream end of said support surface, means for driving said milling roll and hold-back conveyor at different speeds in the direction of stalk travel, said hold-back conveyor driven slower than said milling roll to control the speed of travel of said stalk sections such that the milling roll cuts through the pith of each stalk section faster than the speed of travel of the stalk section to remove the pith therefrom, and means for collecting the removed pith.

8. Apparatus according to claim 7, wherein said milling roll comprises a rotary hub; a plurality of radially projecting cutting blades removably carried by said hub, each blade including at least one cutting edge; means releasably securing said blades to said hub; means carried by said hub and defining first and second reference surfaces at opposite ends of said blades which when contacted by opposite ends of said blades orient the cutting edge of each blade parallel to the axis of rotation of said hub; and adjustable means for displacing said ends of each blade radially outwardly into engagement with said reference surfaces.

9. Apparatus according to claim 8, wherein said adjustable means comprises an adjustment element positioned radially between said hub and two circumferentially adjacent blades and including a manually actuable screw for moving said adjustment element radially outwardly, there being two of said adjustment elements located at opposite ends of said last-named blades, said adjustment elements each being tiltable to displace either of said last-named blades independently of the other.

10. Apparatus according to claim 1, including means for delivering stalks to said endless conveyors, said delivering means comprising an inclined slide ramp including an upper end onto which the stalks are dropped, side walls extending out from said ramp; at least one divider wall extending out from said ramp intermediate said side walls to define a plurality of feed channels for guiding the stalks as they slide along said ramp; an upper end of said divider wall being inclined relative to horizontal such that partially-cut stalks which become hung-up thereon slide downwardly to a lower portion of said upper end; said lower portion of said upper end including a slot, and driven cutter means passing through said slot to completely cut through the partially cut stalks.

11. Apparatus according to claim 1, including means for delivering stalks to said endless conveyors, said delivering means comprising an endless delivery conveyor having an inclined portion and a horizontal portion disposed downstream therefrom; an endless spreader conveyor disposed closely atop said horizontal portion of said delivery conveyor and defining a nip therewith having an inlet facing said inclined portion of said delivery conveyor; a rotary guide roll around which said spreader conveyor extends at said nip inlet; said guide roll being yieldably deformable to permit passage of stalks into said nip; a pressure roll formed of an unyielding material disposed opposite said guide roll, said delivery conveyor traveling around said pressure roll; and means for driving said delivery and spreader conveyors at a common speed such that said inclined portion of said delivery conveyor conveys stalks to said nip inlet and said spreader conveyor rejects stalks not lying flush on said delivery conveyor.

12. In a stalk separator of the type comprising stalk splitting means, feeding means for advancing stalks longitudinally against said splitting means to split the stalks longitudinally in half, a pith-removal station for removing the pith component of said stalk halves from the rind components thereof, said pith-removal station comprising a bladed milling roll and hold-back means defining a nip therebetween for receiving stalk halves, means for driving said milling roll and said hold-back means at different speeds in the direction of stalk travel, said hold-back means being driven slower than said milling roll to control the speed of travel of said stalk halves such that the milling roll cuts through the pith of each stalk half faster than the speed of travel of the stalk half to remove the pith therefrom, means for collecting the removed pith, and a stalk guide member disposed downstream of said milling roll and including a support surface onto which a depithed stalk half travels upon emerging from said milling roll, the improvement wherein said hold-back means comprises an endless belt having outwardly projecting tines, said belt including a stalk contacting portion facing said milling roll, said stalk contacting portion extending downstream beyond an upstream end of said guide member.

13. Apparatus according to claim 12, wherein said support surface includes slots through which pith and juice pass to a pith collection zone.

14. Apparatus according to claim 12, wherein said stalk contacting portion of said belt is at least as long as the length of the stalk halves.

15. A stalk separator comprising:

upwardly facing stalk splitting means, generally horizontal delivery conveyor means for delivering stalks that are aligned with their direction of travel, feeding means comprising endless conveyors including mutually facing stalk means and defining a stalk conveying nip, said stalk gripping sections each including contiguous horizontal and vertical portions, said horizontal portions extending to said delivery conveyor means to receive stalks therefrom, and said vertical sections extending from said horizontal sections to said splitting means, to convey stalks from said delivery conveyor means and against said splitting means to split the stalks, and means for removing at least a pith portion of the split stalks.

* * * * *